United States Patent [19]

Gertz

[11] Patent Number: 4,944,686

[45] Date of Patent: Jul. 31, 1990

[54] SOLDERLESS ELECTRICAL CONNECTOR

[75] Inventor: Jonathan Gertz, Lexington, Ky.

[73] Assignee: Audio Authority Corporation, Lexington, Ky.

[21] Appl. No.: 345,698

[22] Filed: May 1, 1989

[51] Int. Cl.[5] ..... H01R 11/32

[52] U.S. Cl. ..... 439/175; 439/177; 439/462; 439/891

[58] Field of Search ..... 439/461, 462, 625, 891, 439/176, 884, 427, 475, 175, 177

[56] References Cited

U.S. PATENT DOCUMENTS

| | | | |
|---|---|---|---|
| 1,922,686 | 8/1883 | Johnson et al. | 439/461 |
| 2,076,072 | 4/1937 | Douglas | 439/462 |
| 2,716,737 | 8/1955 | Maberry | 439/176 |
| 2,736,877 | 2/1956 | Bychinsky . | |
| 3,411,129 | 11/1968 | Peters . | |
| 3,675,189 | 7/1972 | Smith | 439/891 |
| 3,984,168 | 10/1976 | Korman . | |
| 4,367,001 | 1/1983 | Munakata | 439/175 |

FOREIGN PATENT DOCUMENTS 1285750 1/1962 France .

*Primary Examiner*—Gary F. Paumen
*Attorney, Agent, or Firm*—King & Schickli

[57] ABSTRACT

A solderless connector includes a body member having a resilient collet for engaging an insulated electrical conductor. A securing sleeve includes mating threads for engagement with the body member. As the sleeve is tightened on the body member anchoring cams on the sleeve press the resilient collet into the insulation about the electrical conductor so as to securely hold the body member in position. A conductor spike, concentrically disposed within the collet and attached to the body member makes contact with the electrical conductor. The solderless conductor also includes a pin connector terminal for making electrical contact with an electrical apparatus. The pin connector terminal includes a frangible weakened zone so that the terminal may be broken off from the body member if desired. A threaded connection may then be utilized to mount an alternative terminal, such as a banana plug or spade terminal, to the body member.

14 Claims, 4 Drawing Sheets

W
50
40
42
B
I
22
44
12
18
16
34
10
24

W
50
48
B
40
I
42
22
44
46
16
20
12
18
34
10
32
28

W
B
I
48
40
50
42
22
44
16
18
12
34
10
32
30

SOLDERLESS ELECTRICAL CONNECTOR

TECHNICAL FIELD

The present invention relates generally to electrical connectors and, more particularly, to a solderless electrical connector that may be utilized to connect an electrical conductor such as a speaker wire to an electrical apparatus such as a speaker, stereo receiver, or stereo amplifier.

BACKGROUND OF THE INVENTION

A number of different connector terminals have been developed for connecting an electrical conductor to an electrical apparatus or appliance. Each of the different connector terminals have specific characteristics and advantages that lead to their utilization by component manufacturers of, for example, stereo receivers, stereo amplifiers and speakers. For example, the utilization of a threaded post and a cooperating locking nut designed to receive and clamp a spade terminal is relatively common. Advantageously, this construction is relatively inexpensive while also providing a strong and dependable electrical contact. This type of connection is, however, relatively unsophisticated and somewhat inconvenient for the owner/operator to change, when, for example, setting-up or breaking-down a stereo system. As such, higher priced stereo equipment may utilize a more sophisticated socket connection designed to receive a straight pin connector terminal or more preferably, a banana plug terminal. Such connector terminals are particularly convenient to use as they may simply be plugged-in or unplugged from the apparatus in a single motion.

Often, stereo equipment of different manufacturers is mixed and matched in order to display stereo systems at retail outlets. Similarly, mixed and matched systems are often purchased by consumers. Since the different components may utilize different type connector terminals, the terminal ends of electrical conductors such as speaker wires need to be customized to any particular application. For example, a speaker wire may require a banana plug terminal at one end for connection into a stereo receiver and a spade terminal at the opposite end for connection to a loudspeaker.

In the past, an individual seeking to mix and match stereo components had to first determine exactly what equipment was to be connected and the type of connector terminal required to complete the connection between the components at each end of the electrical conductor. The necessary connector terminals then had to be connected to the electrical conductor so as to allow proper connection of the equipment. Where equipment was subsequently changed, it often was necessary to cut the electrical conductor to remove the old connector terminal and then attach the new connector terminal appropriate to complete connection with the new equipment. This is, of course, a rather inconvenient and time consuming procedure.

In order to alleviate this problem the present invention is directed to a solderless electrical connector that may be purchased in kit form and is readily adaptable to connect different components of, for example, a stereo system regardless of the required connector terminal configuration.

SUMMARY OF THE INVENTION

Accordingly, it is a primary object of the present invention to provide a solderless electrical connector of simple construction that is relatively inexpensive to produce.

Another object of the present invention is to provide a versatile solderless electrical connector that may be utilized to connect components of different manufacturers that utilize various connector terminal designs.

Yet another object of the present invention is to provide a solderless electrical connector that is durable and provides reliable performance.

Still another object of the present invention is to provide a solderless connector that is especially convenient to utilize in connecting audio components such as speakers and receivers or amplifiers and that is readily adaptable to connect those components regardless of connector terminal configuration.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved solderless electrical connector is provided for connecting an insulated electrical conductor such as a speaker wire to an electrical apparatus such as a stereo receiver, amplifier and/or loudspeaker. The connector comprises a body member and means for connecting the body member to the electrical conductor. Mounted to the body member is an electrical conducting element including means, such as a conductor spike, for making electrical contact with the electrical conductor. The conductor element also includes a terminal adapted for making electrical contact with the electrical apparatus. This terminal includes a weakened zone for allowing the selective breaking off of the terminal from the conducting element and body member.

More preferably, this weakened zone may be formed by an area of reduced cross section or a segment of the terminal that is constructed from weaker material. More specifically, the weakened zone is sufficiently strong to allow normal utilization of the terminal, such as a pin connector that may be plugged in and unplugged from a cooperating socket of an electrical apparatus. When desired, however, a tool such as a pair of pliers may be clamped to the distal end of the pin connector and the pin connector bent back-and-forth across the weakened zone until the pin connector breaks at that point. Then, in accordance with a further aspect of the present invention, an alternative terminal such as a spade terminal or banana plug terminal may be connected to the solderless connector to allow connection of the electrical conductor and apparatus utilizing one of these alternative types of terminals.

Preferably, the weakened zone is formed by a circumferential groove extending around the pin connector terminal. The weakened zone or groove is also provided adjacent a series of threads or other means for the secure mounting of the alternative terminal.

No matter which of the various terminals is utilized with the connector, the connector is maintained in secure electrical contact with the electrical conductor at all times. In order to achieve this end the body member includes a resilient collet having a series of projecting legs. In addition, a securing sleeve is provided. The securing sleeve and body member each include mating threads for engagement.

In order to connect the connector to the electrical conductor, the securing sleeve is first positioned concentrically around the insulated electrical conductor back from the distal end of the conductor. Next, the resilient collet of the body member is slipped over the distal end of the conductor. As this is done, the conductor spike is pressed into the electrical conductor so as to make electrical contact. The securing sleeve is then slipped over the body member and tightened by twisting through engagement of the mating threads. As the sleeve is tightened, anchoring cams at the end of the sleeve force or squeeze the legs of the collet together into engagement with the insulation of the electrical conductor so as to provide a firm and secure mounting of the solderless connector to the conductor.

In an alternative embodiment of the present invention, the body member, including the resilient collet and the securing sleeve remain the same. The electrical conducting element mounted in the body member is, however, modified slightly.

More specifically, the conducting member includes only the conductor spike at one end and a connector terminal mounting means at the opposite end. The mounting means may take the form of a series of threads that cooperate with a threaded adapter on a selected terminal to allow the mounting of any selected terminal to the end of the electrical conducting element.

Still other objects of the present invention will become readily apparent to those skilled in this art from the following description wherein there is shown and described a preferred embodiment of this invention simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrates several aspects of the invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
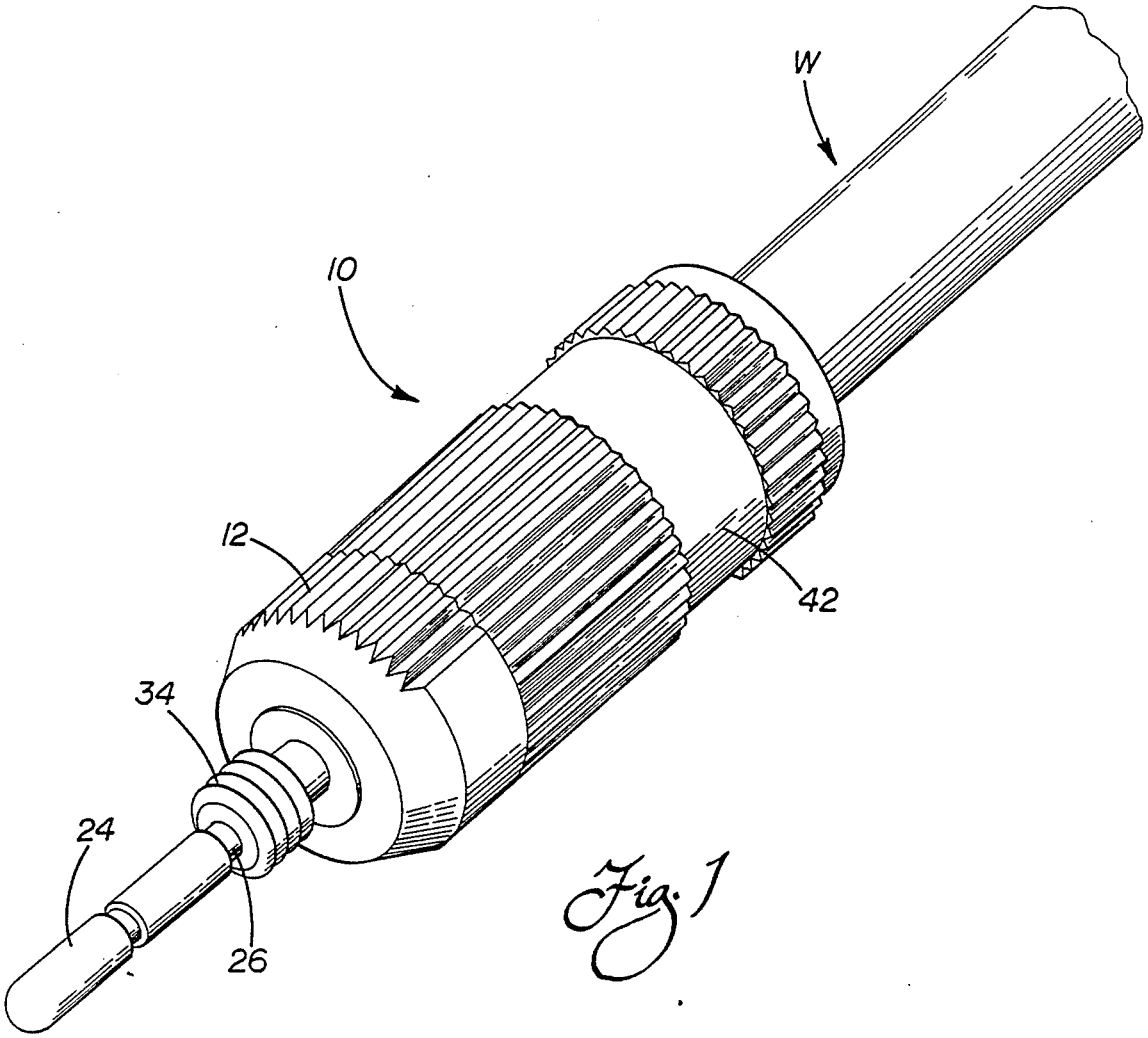
FIG. 1 is a perspective view of the solderless electrical connector of the present invention.

Reference is now made to FIG. 1 showing the solderless electrical connector 10 of the invention for connecting an insulated electrical conductor, such as speaker wire W, to an electrical apparatus such as a stereo amplifier, stereo receiver or loudspeaker (not shown). As is known in the art, the speaker wire includes a wire braid B of a conducting metal such as copper and/or aluminum encased in plastic or rubber insulation I.

Figure 2:
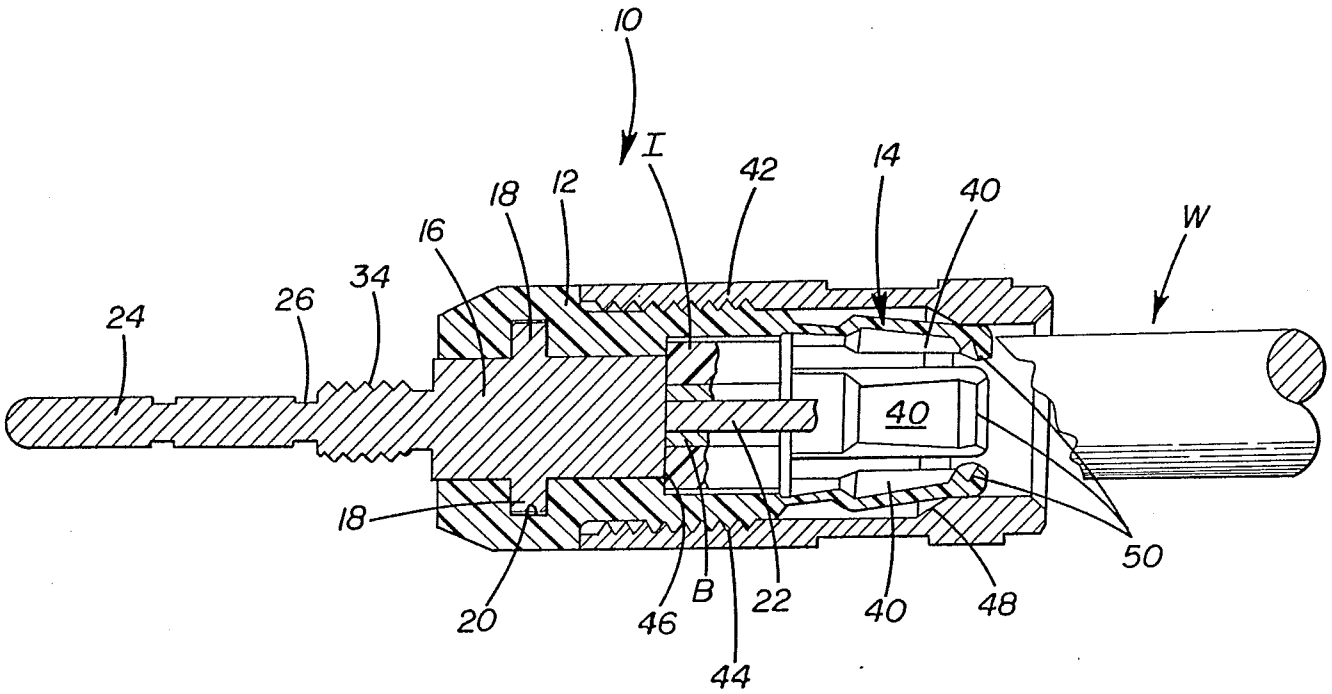
FIG. 2 is a cross-sectional view of the solderless electrical connector showing the connector connected to an electrical conductor.

As best shown in FIGS. 1 and 2, the apparatus 10 includes a body member 12. The body member 12 has a substantially cylindrical configuration. Preferably, the body member 12 is molded from plastic or other material having insulating properties. Further, the body member 12 includes a resilient collet 14 for engaging and squeezing the insulation I of the electrical conductor W. In this way the connector 10 is mounted to the electrical conductor W as described in greater detail below. An electrical conducting element 16 is connected to and received within the body member 12. For example, the conducting element 16 may include a flange 18 that is received and held within a cooperating groove 20 in the body member 12 so as to hold the conducting element and body member tightly together.

As best shown in FIG. 2, the conducting element 16 includes a conductor spike 22. The spike 22 is concentrically disposed within the center of the resilient collet 14. Thus, as the connector 10 is pushed over and attached to the distal end of a electrical conductor W, the spike 22 is pressed into and makes electrical contact with the conducting braids B of the conductor throughout its entire length.

A terminal, in the form of a pin connector 24 extends from the opposite end of the conducting element 16. Where appropriate this pin connector terminal 24 may be utilized to connect the electrical conductor W to an electrical apparatus such as a stereo receiver by simply plugging into a cooperating socket provided on the receiver.

As discussed above, however, not all component manufacturers utilize sockets designed to receive terminals of the pin connector type 24. In the past, where a conductor W was to be connected to a different electrical apparatus utilizing a different type of connector terminal, the original terminal had to be removed by cutting from the conductor. Then a new terminal, appropriate for connection to the apparatus had to be installed on the electrical conductor W. This was an inconvenient and time consuming task. In addition, it should be appreciated that the cutting of the old terminal from the conductor serves to shorten the conductor. This is a significant problem where equipment and, consequently, conductors are often changed as, for example, occurs at stereo equipment retail outlets. This is because the conductor is further shortened with each terminal change. Eventually, the conductor becomes too short to complete the connection between stereo components and it must be replaced at additional time and expense. Advantageously, the present invention successfully addresses these problems.

More particularly, the pin connector 24 is provided with a frangible weakened zone 26. As shown in the Figures, the zone 26 is formed by a circumferential groove extending around the pin connector terminal 24. It should be recognized, however, that as an alternative, the weakened zone could also be formed by incorporating a weaker material in the construction of a segment of the pin connector terminal 24.

Figures 3, 4, 5:
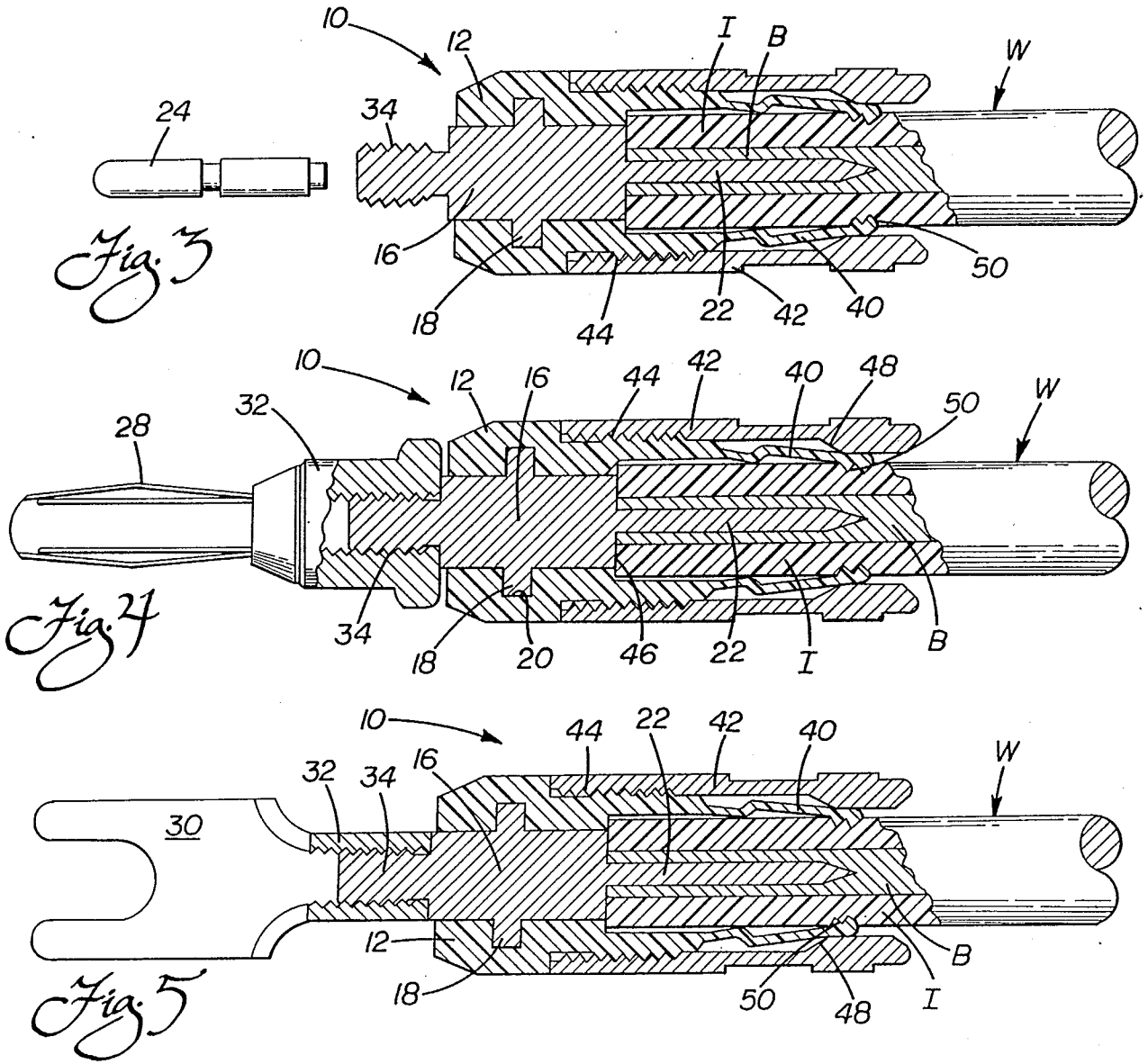
FIG. 3 is a cross-sectional view similar to FIG. 2 but showing the breaking off of the pin connector terminal from the electrical connector.
FIG. 4 is a view similar to FIG. 3 but showing the mounting of an alternative banana plug terminal to the connector.
FIG. 5 is a view similar to FIG. 4 but showing the mounting of an alternative spade terminal to the connector.

When it is desired to change from a pin connector terminal 24 to an alternative terminal such as a banana plug 28 (see FIG. 4) or a spade terminal 30 (see FIG. 5), the pin connector terminal 24 is broken off at the weakened zone (see FIG. 3). More specifically, pliers may be utilized to grip the distal end of the pin connector terminal 24 and bend the terminal in a back-and-forth manner (see action arrow A) relative to the body member 12 of the pin connector 10 at the weakened zone 26. The connector terminal 24 will then break off at the weakened zone 26 as shown in FIG. 3. The appropriate alternative terminal 28 or 30 may then be attached to the connector 10 as shown in FIGS. 4 and 5. More particularly, the alternative connector terminal 28, 30 includes a threaded adapter head 32. The head 32 is specifically designed to engage mounting threads 34 provided on the conductor element 16.

Figure 6:
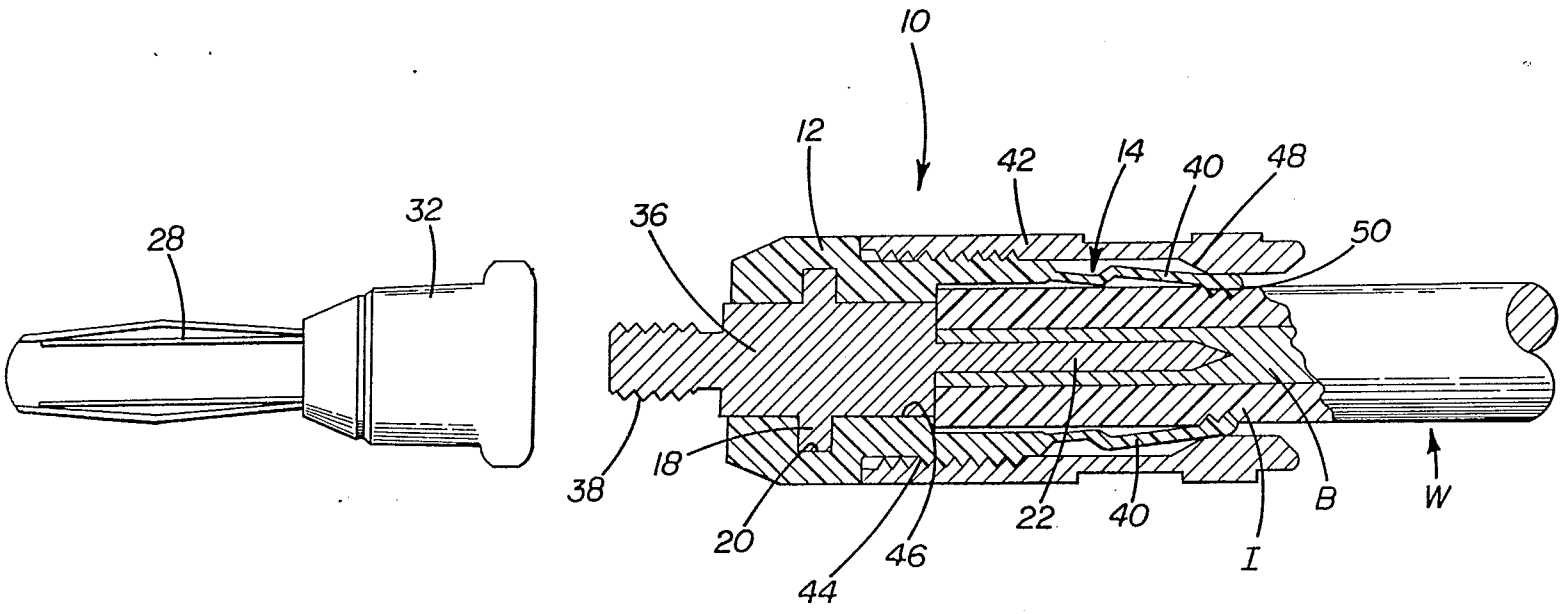
FIG. 6 is a cross sectional view of an alternative embodiment of the solderless electrical connector of the present invention.

In an alternative embodiment of the present invention shown in FIG. 6, a modified version of the electrical conducting element 36 is mounted within the body member 12 as described above. As shown, the conducting element 36, like the conducting element 16, includes a conductor spike 22 for making electrical contact with the wire braids B of the conductor W. At the opposite end, the conducting element 36 includes only a threaded segment 38 extending from the body member 12. Various types of connector terminals, such as the banana plug terminal 28 and spade terminal 30 shown in FIGS. 4 and 5 or even a pin connector terminal (not shown), may be securely connected to the conducting element 36. More particularly, as described above, each of these terminals 28, 30 is equipped with an adapter head 32 specifically designed to engage the threaded segment 38 provided on the conducting element 36 to allow connection.

No matter which embodiment of the invention is utilized, the solderless electrical connector 10 must be securely attached to the wire conductor W. To achieve this end, the resilient collet 14 of the body member 12 is provided with a series of projecting legs 40. In addition, a securing sleeve 42 is provided. The securing sleeve 42 and body member 12 each include mating threads 44 for engagement.

In order to connect the connector 10 to the electrical conductor W, the securing sleeve 42 is positioned concentrically around the conductor W and pushed back from the distal end. Next, the body member 12 is pushed onto the distal end of the conductor (note action arrow B in FIGS. 2 & 6) until the end of the conductor butts against the rear face 46 of the conducting element 16 or 36. This serves to force the conductor spike 22 into the wire braids B of the conductor W so as to make strong electrical contact.

Once this is done, the securing sleeve 42 is pulled up over the projecting legs 40 of the collet 14 until the mating threads 44 are brought into engagement. The securing sleeve 42 is then tightened onto the body member 12 by twisting in a clockwise direction. This causes the sleeve 42 to be drawn further up onto the body member 12 (note action arrow C). As this occurs, anchoring cams 48 provided at the rear of the sleeve 42 force or squeeze the legs 40 of the collet 14 together about the electrical conductor W. This causes teeth 50 at the end of the legs 40 to engage into the insulation I of the conductor W and thereby firmly hold the connector 10 in position.

Once so mounted, the individual simply selects the connector terminal 24, 28, 30 necessary to make the desired electrical connection between the conductor W and the electrical apparatus. Either the pin connector terminal 24 or the alternative terminal 28, 30 following attachment to the connector 10 as described above is then utilized to make the connection of the conductor W to the apparatus.

In summary, numerous benefits have been described which result from employing the concepts of the present invention. More specifically, the solderless connector 10 is particularly versatile and may be adapted through the utilization of the appropriate cooperating connector terminal 24, 28 or 30 to connect an electrical conductor W to an electrical apparatus regardless of manufacturer or type of connector terminal presented. As such, the connector 10 of the present invention is particularly convenient for utilization by, for example, audio component retailers who typically and periodically mix and match different components of different manufacturers which utilize different terminal connection systems. In fact, the connector 10 eliminates the need to cut the conductor and replace the connector each time a different type of connector terminal is required to connect to the selected electrical apparatus. Of course, individual purchasers of component systems also benefit from utilization of the connector 10 as it allow them the ability to readily connect to any type of equipment that may be purchased.

The foregoing description of a preferred and alternative embodiment of the invention has been presented for purposes of illustration and description. It is not intended to be exhaustive or to limit the invention to the precise form disclosed. Obvious modifications or variations are possible in light of the above teachings. The main and alternative embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. A solderless connector for connecting an insulated electrical conductor to an electrical apparatus, comprising:

a body member;

means for connecting said body member to the electrical conductor;

means mounted to said body member for making electrical contact with said electrical conductor;

terminal means mounted to said body member for making electrical contact with said electrical apparatus;

means on said terminal means for mounting an alternative terminal means; and a weakened zone on said terminal means that is frangible to allow the selective breaking off of said terminal means from said body member and the attachment of an alternative terminal means to said means for mounting.

2. The solderless connector of claim 1, wherein said weakened zone is an area of reduced cross-section.

3. The solderless connector of claim 2, wherein said weakened zone is formed by a circumferential groove extending around said terminal means.

4. The solderless connector of claim 1, wherein said weakened zone is an area of reduced cross-section provided on said terminal means adjacent said means for mounting an alternative terminal means.

5. The solderless connector of claim 4, wherein said weakened zone is formed by a circumferential groove extending around said terminal means.

6. The solderless connector of claim 1, wherein said terminal means is a pin connector.

7. The solderless connector of claim 1, wherein said alternative terminal means is a banana plug terminal.

8. The solderless connector of claim 1, wherein said alternative terminal means is a spade terminal.

9. The solderless connector of claim 1, wherein said means for connecting said body member comprises a securing sleeve received about said body member.

10. The solderless connector of claim 9, wherein said body member includes a resilient collet for engaging said electrical conductor.

11. The solderless connector of claim 10, wherein said securing sleeve and body member include mating threads for engagement therebetween and said securing sleeve also includes anchoring cams for forcing said resilient collect into engagement with the insulation of said electrical conductor.

12. The solderless connector of claim 11, further including teeth on said resilient collet to engage the insulation of said electrical conductor.

13. The solderless connector of claim 1 including a banana plug terminal as an alternative terminal means.

14. The solderless connector of claim 1 including a spade terminal as an alternative terminal means.

* * * * *